United States Patent [19]

Glockenstein

[11] Patent Number: 4,881,352

[45] Date of Patent: Nov. 21, 1989

[54] WALL PANEL ARRANGEMENT

[76] Inventor: Karl Glockenstein, Mautner Markhofg., Vienna, Austria, 1110

[21] Appl. No.: 226,107

[22] Filed: Jul. 29, 1988

[30] Foreign Application Priority Data

Jul. 30, 1987 [AT] Austria ..... 1932/87

[51] Int. Cl.[4] ..... E04H 1/00

[52] U.S. Cl. ..... 52/239; 52/220

[58] Field of Search ..... 52/239, 220, 221, 238.1, 52/243, 243.1, 288, 241, 242

[56] References Cited

U.S. PATENT DOCUMENTS

| | | | |
|---|---|---|---|
| 3,341,992 | 9/1967 | Piper | 52/243.1 |
| 3,377,756 | 4/1968 | Polhamus | 52/220 |
| 3,568,383 | 3/1971 | Judkins et al. | 52/242 |
| 3,722,157 | 3/1973 | Prokop | 52/241 |
| 4,662,131 | 5/1987 | Glockenstein | 52/238.1 |

FOREIGN PATENT DOCUMENTS

| | | |
|---|---|---|
| 2644559 | 2/1976 | Fed. Rep. of Germany . |
| 107326 | 5/1973 | German Democratic Rep. . |
| 1384587 | 4/1972 | United Kingdom . |

*Primary Examiner*—David A. Scherbel
*Assistant Examiner*—Michele A. Van Patten
*Attorney, Agent, or Firm*—Townsend and Townsend

[57] ABSTRACT

The present invention relates to a wall panel arrangement having one or more wall panels comprising a bearing frame constructed of U or C profiles. On both sides of this frame there are covering sheets and between these sheets there is a filling of thermal and/or acoustic insulation material. One or more bracing devices are arranged on one or more bearing frame edges serving to compensate for dimensional differences between the wall panel and the building structure receiving such wall panel. One or more parts of the bearing frame can be or is capable of being recessed relative to one or more edges of one or more covering sheets. The primary distinguishing feature of the present invention is a bearing part, which, for the purpose of securing the wall panel to the building structure and, if required, connecting adjacent wall panels to each other, extends or is capable of being guided only into the space existing between the covering sheets. Such bearing part furthermore comprises a U or C profile having shanks that extend or that can be introduced only into the above-mentioned space and that are, furthermore, bent at least at the ends, and advantageously to approximately half the height of such shank, toward the median of the profile and enclosing with the median plane of the profile an acute angle, whereby the web of such U or C profile features securing means for the purpose of anchoring such bearing part and thus also the wall panel to the building structure, and whereby the bearing frame comprises, in the edge zone facing such bearing part, a U or C profile separated from the aforementioned bearing part and arranged only inside the covering sheets, such U or C profile being open toward the bearing part, the distance between the shanks of which U or C profile being greater than the distance separating the outer surfaces of the shanks of the bearing part, and wherein the bearing frame features, in the wall panel sides or zones distant from the bearing part, U or C profiles having an outwardly-facing web and thus an inwardly-opening profile, and being arranged only inside the covering sheets.

14 Claims, 15 Drawing Sheets

Fig. 12
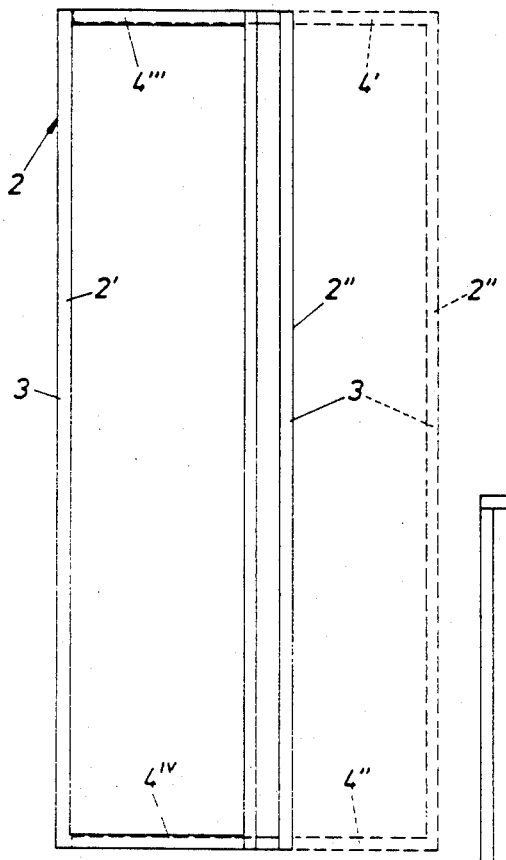
Fig. 13
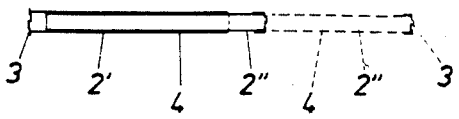
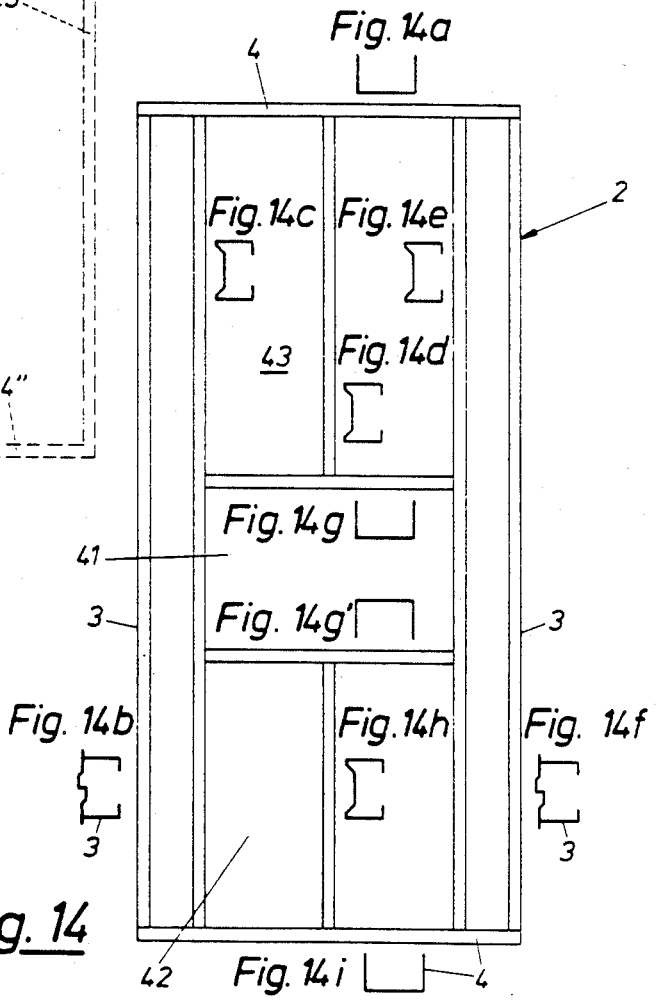
Fig. 14

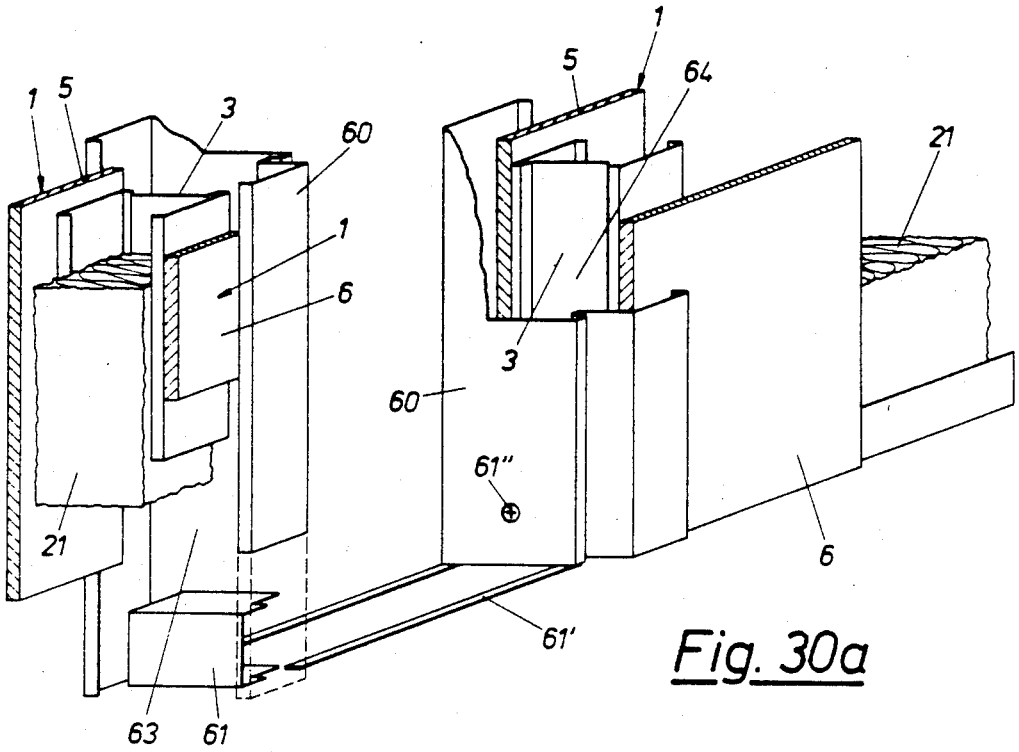
Fig. 30a
Fig. 30b
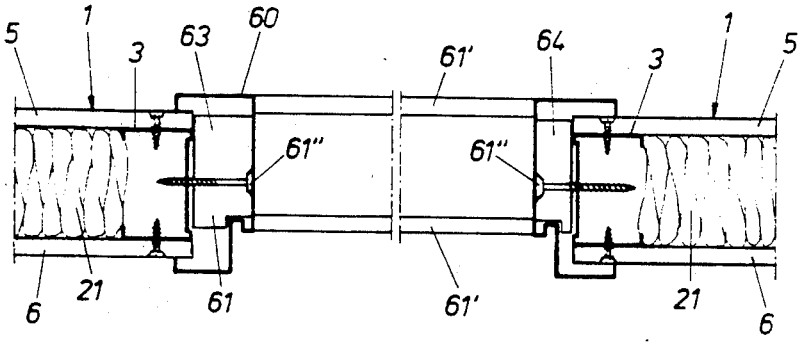

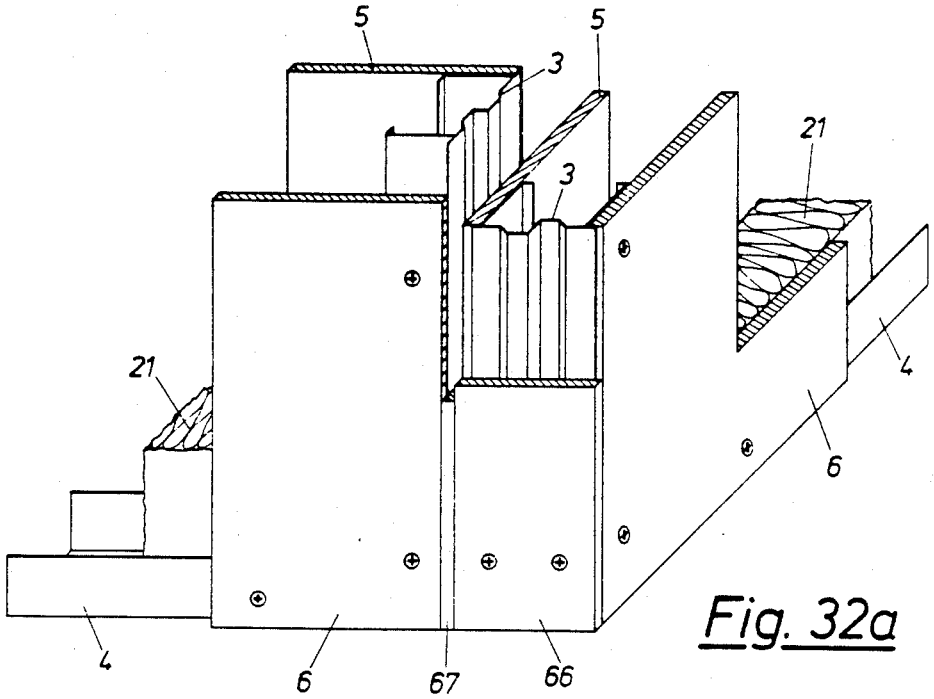
Fig. 32a
Fig. 32
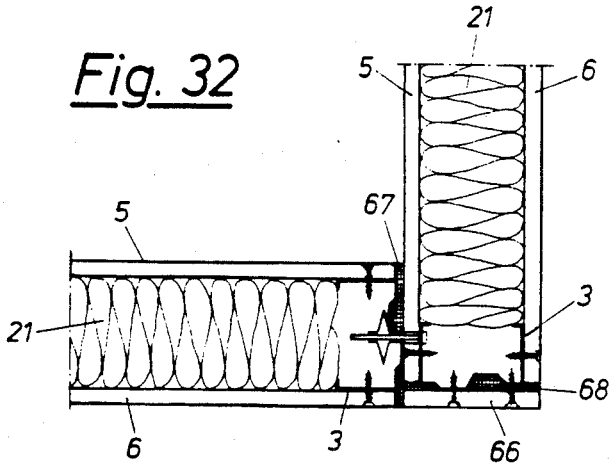

WALL PANEL ARRANGEMENT

BACKGROUND OF THE INVENTION

The present invention relates to a wall panel arrangement, especially suitable for interior construction in buildings, such wall panel arrangement having one or more wall panels constructed of a bearing profile comprising U or C profiles which are especially of metal, but preferably of steel or plastic. On both sides of the wall panel arrangement are affixed covering sheets, preferably of gypsum board. Between such sheets there is a filling comprising a heat and/or acoustic insulation material, preferably mineral wool. A bracing device is located on one or more bearing frame edges, such bracing device serving to compensate for unevennesses in the dimensions between the wall panel and the building structure accommodating such wall panel, whereby one or more parts of the bearing frame is or can be recessed in relation to one or more edges of one or more covering sheets.

SUMMARY OF THE INVENTION

It is an object of the invention to provide a wall panel arrangement that employs to the greatest extent possible prefabricated wall panels and affords adaptability to the spatial dimensions of buildings up to a given size without necessitating lengthy assembly procedures on the construction site. The arrangement according to the invention offers foremostly the erection of partition walls in interior construction without the use of adhesives and without requiring extensive professional knowledge, tools or special devices. The present invention also eliminates the need for putting up facing.

Industrially prefabricated wall panels comprising a frame construction on both sides of which are attached covering sheets, have found wide acceptance in the field of prefabricated construction. Such wall panels are, in part, produced according to set dimensions; their thickness and dimensions are, however, designed for a specific type of prefabricated dwelling, in which they are exclusively employed. The advantage of such wall panels lies on the one hand in their production line manufacture, and thus in a lower cost of production. This cost savings is, however, limited in the case of the known wall panels due to their use exclusively in certain types of prefabricated house construction, which reduces any rationalization advantages which could accrue from a production line assembly of the units.

On the other hand, wall constructions are known, in which a wall can be produced on the construction site, which permits the wall panel to be individually adapted to different house dimensions or types. The advantage gained by individual adaptability on the one hand is offset by the attendant loss of rationalization, since, in place of prefabricated wall panels, construction of the latter is carried out on the construction site.

It is another object of the invention, to use the greatest number of prefabricated components as possible that can be adapted to varying building dimensions, while on the other hand providing for the simplified erection of such prefabricated components. In addition, the installation of electrical, sanitary and gas conduits is facilitated.

These and other objects of the present invention maybe achieved by providing a wall element arrangement of the type mentioned above that features, for the purpose of securing the wall panels to the building structure, particularly to ceiling and also, if required, to other wall panels, one or more bearing parts that extend or fit only into the space between the covering sheets, such bearing part comprising a known U or C profile having profile shanks that extend or fit only into the above-mentioned cavity, and are advantageously bent to about the mid-point of the shanks and toward the mid-line of such profile to form an acute angle with the median plane of such profile, whereby the web of the U or C profile features securing sites, which are preferably slots, for the purpose of anchoring the bearing part and thus the wall panel to the building structure, more especially to the ceiling. The bearing frame of the proposed wall panel also features in its edge zone facing the bearing part, a U or C profile arranged only inside the covering plates and separated from the above-mentioned bearing part, the distance separating the shanks of such U or C profile being greater than the distance between the outer surfaces of the shank of the bearing part. The bearing frame moreover features, in the sides or zones of the wall panel separated from the bearing part and advantageously in the zone of the wall panel spaced from such bearing part, more particularly on the floor side of the wall panel, and only inside the covering plates, U or C profiles whose web faces the outside and whose profile therefore opens to the inside.

The bends provided in the bearing part for the purpose of receiving the facing open profile of the bearing frame facilitates not only the erection and securing of the wall panels particularly to the roof, but also the placement therein of plumbing and electrical pipes.

A wall panel version known from GB-PS 1 384 587, in particular in accordance with FIG. 3 of the same specification, features a profile suitable for securing a wall panel to the ceiling. Such a profile does not only have flanges that extend between the covering plates and into the intermediate space, but also flanges arranged on the outside of the covering sheets, which despite a bend in the lower ends of the inside shanks, do not favor easy assembly. Also absent from this known specification are the bearing frames constructed of U or C profiles, the proposed bracing device, and the recessing of the bearing frame relative to the covering sheets. The construction according to the invention not only eases considerably the task of installation but provides an effective means of securing the wall panels and erecting or installing such panels inside building.

The construction described in DD-PS 107 326 lacks, again, the bend in the profile shank of the upper bearing part, which facilitates wall panel erection, as well as the profile of the bearing frame that accommodates such bearing part (In particular, see FIGS. 2, 5 and 6).

Described in DE-OS 26 49 559, and particularly in FIG. 4 thereof, is a U-shaped bearing part suitable for securing a wall section to the ceiling; its shanks are not, however, bent in the manner suggested by the present invention. Such an arrangement provides for a complicated connection between this bearing part and the wall section effected through a specially designed profile, whereby additional plastic elements are required (FIG. 12). Construction and assembly are thus expensive. The bearing frame and bracing devices according to the present invention are not present in the prior art version.

The proposed system permits contiguously-arranged wall panels to be assembled flush together. It is sufficient, if according to the invention, the bearing part is shorter, or considerably shorter, than the shanks of the cooperating frame profile with or into which such bearing part either fits or extends. The proposed system enables, with the aid of the lower half of the shanks of such bearing part profile, the efficient fitting of the wall panels, in particular, their edges, and above all their upper frame profiles, over the bearing parts, if only the lower half of the shank of the bearing part profile is bent toward the midline of the bearing part profile. The proposed system permits a particularly effective means of accommodating plumbing or electric conduits, whereby shank ends constitute a continuation of the profile shank (sections) that form an acute angle with the median plane of the profile of the bearing part, whereby such bent section are considerably shorter than half the length of the web of the U or C profile. The rigidity and, where required, load bearing capacity of the proposed arrangement are improved if, arranged inside the bearing frame of the wall profile, and between a U or C profile of the bearing frame opening to the outside and a U or C profile of the bearing frame opening to the inside, there is a support embodied at least as a U or C profile that serves to brace the system.

A further embodiment of the present invention serves to brace and properly fit together the wall sections along their integral height by employing lateral U or C profiles of the bearing frame whose webs feature depressions and raised areas that form a somewhat trapezoidal cross-section, such depressions and raised areas corresponding, where wall panels are to be fitted together, to the lateral profile of the adjacent wall panel in question, and furthermore fitting together in the manner of a tongue and groove arrangement, whereby such webs are also extended beyond the outer surfaces of the shanks of the U or C profiles in such a way as to aid in supporting the covering sheets.

The invention provides a particularly effective means of bracing the prefabricated wall sections after placement over the above-mentioned bearing parts, whereby the web of the U or C profile of the bearing frame, which is arranged in the zone of the wall panel recessed from the bearing part, in particular on the floor side of the wall panel, features one or more apertures into which a plate possessing a thread is inserted, into which thread an adjusting screw is screwed which serves to compensate for discrepancies in dimension between the wall panel and the building structure accommodating such wall panel, more particularly in relation to differences in the distance between ceiling and floor, the shaft of such screw being introduced through an orifice in the above mentioned web, and the head of such screw being supported upon the underlying building structure, particularly the floor.

Additional compensating means are provided if, arranged between the web of the U or C profiles of the bearing frame, which is arranged inside the wall panel zone recessed from the bearing part, in particular on the floor side of the wall panel, and the edge of the adjacent wall panel or floor, at least to a large extent within the cover sheets, is an advantageously replaceable and hollow spacing member, which is more particularly a U or C profile, which lies against the web and features one or more apertures into which a plate is inserted, such plate possessing a thread into which is screwed an adjusting screw serving to compensate for differences in dimension between the wall panel and the building structure accepting such wall panel, such differences being especially those relating to the distance of floor to ceiling. The shaft of the screw is introduced through an aperture in an opening provided in the spacing member and, if required, in the above-mentioned web, whereby the head of such screw is supported against the adjacent building structure, which in this case is the floor.

The present invention provides for further adjustment arrangements, more particularly in the horizontal direction, whereby the bearing frame that is held in position above the bearing part, which extends with its bent shank ends only into the space between the covering sheets, comprises one or more closed sections that are always attached to the covering sheets, and one or more open frame parts or profiles that are either slidable in or on such part, whereby the covering sheet can be trimmed at least in the zone of the slide path of the open frame part. In addition, the external dimensions of the profiles or profiles sections of the open frame part capable of sliding inside the closed frame part, are smaller than the internal dimensions of the profile part of the closed frame part that accommodates such profile parts. Such an arrangement permits effective adaptation to the designated wall width or length, even where industrially prefabricated wall panels are provided.

The task of building subcontractors, in particular plumbers and electricians, is facilitated or rather, greatly simplified, if the proposed wall panels, which are held above the bearing part that extends with bent shank ends only into the space between the covering sheets, have two or more closed frames arranged one on top of the other, whereby the uppermost or upper frame features a U or C profile open toward the top which fits around the above-mentioned bearing part having inwardly bent profile shanks, and possess, at the bottom, an upwardly opening U or C profile capable of resting on top of a downwardly opening U or C profile of an open or closed frame situated directly beneath, the closed version of such open or closed frame featuring a U or C profile opening to the top and serving as a lower limit, and whereby two or more standing or vertical profiles, in particular U or C profiles, are slidably arranged inside the profile cavities of both such profiles of the lower closed frame whereby planks or similar components can be arranged between such profiles. Attached to such bearing planks can be wash stands and their plumbing fixtures, and such bearing lumber can be delivered to the construction site already installed inside the wall panels between the covering sheets; such bearing lumber can, for example, be brought into the required position after the standing profiles have been positioned inside the lower frame section. Openings for windows and serving hatches can be provided in this or a similar manner, whereby a lower frame is situated below such opening, with its uppermost or upper downwardly opening U or C profile arranged at a distance beneath the above-mentioned upwardly opening U or C profile, and whereby the covering sheets are discontinuous in the separation zone between the two profiles.

Bracing means can, if required, be installed in the bearing frames, in order to enhance or modify the load bearing capacity of the bearing elements, according to the desired application. Such bracing can be achieved if the closed frames are braced on the inside, for example, by standing or vertical profiles, and if, where required, closed frames are arranged one on top of the other between additional standing or vertical profiles located between the covering sheets, whereby such profiles constitute the lateral profiles of such frames and are oriented parallel to the standing or vertical outer profiles of the wall panels.

If the system is to compensate for ceiling warping, a further embodiment of the present invention provides, under appropriate conditions, a means of reducing the height of the wall panel held above the bearing part with its bent shank ends that extend only into the space provided between the covering sheets, to a height less than that of the inner height of the room or similar distance that is to say, the distance separating floor and ceiling. In this arrangement, the shanks of the open uppermost profiles of the bearing frame facing the bearing part can surround such bearing part only in the lower zone of its shanks, and a means is provided to bridge the gap remaining between the wall panel, whereby elastic angular profiles made, for example, of rubber are employed.

The system according to the present invention also suggests a method of facilitating the suspension of the wall sections in limited applications whereby the bearing part features two different shanks or two shanks of different lengths that extend or fit into the space between the covering sheets.

The proposed system simplifies subcontracted tasks such as finish carpentry and electric wiring installation in accordance with alternate versions of the invention, whereby between U or C standing or vertical profiles of closed or open lower frames there are openings for doors or windows, the bases of such profiles lying against such openings and e.g. the edges of the openings are provided with steel frames or similar components, featuring special recesses for e.g. lock cases or hinge mountings etc., and/or whereby insulating pipes, which can be of the bendable variety, are mounted in the uppermost U or C profile or in the bearing part and, if required, between the covering sheets, such insulating pipes serving to accommodate electrical wiring or similar conduits. One or more apertures are made in the web of the uppermost profile of the bearing frame and, if required, beneath such bearing frame in the covering sheets, such apertures serving furthermore to accommodate electrical wiring and being also made in lateral profiles and/or in floor or intermediate profiles of the bearing frame.

Various embodiments of the present invention will now be described with reference to the annexed drawings.

BRIEF DESCRIPTION OF THE DRAWINGS

FIGS. 12 and 13 show wall panels slid into one another;

FIGS. 14 to **14*i*** show a frame assembly suitable for a wall panel having a centrally located serving hatch;

FIGS. 32 and **32*a*** show a connection on arrangement between the interior wall cover and the interior wall;

DESCRIPTION OF THE PREFERRED EMBODIMENTS

In the following description, corresponding, or the same type of components, are indicated by the same reference numbers.

Figure 1:
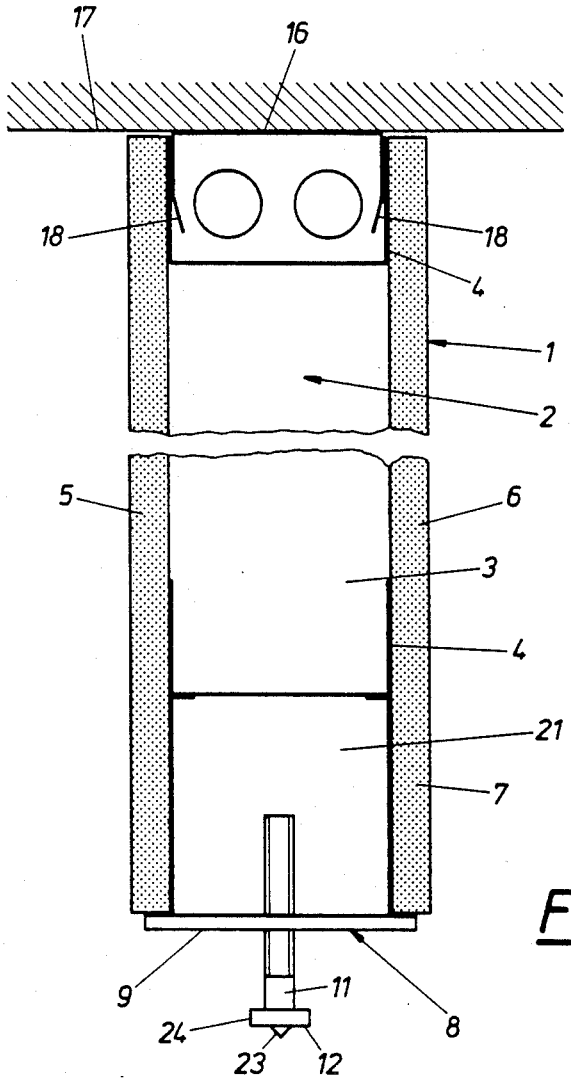
FIG. 1 is a vertical section through an arrangement according to the invention, of a wall panel with corresponding bearing part as well as a spacing profile and a bracing device situated at the lower edge of the bearing frame.
Figure 2:
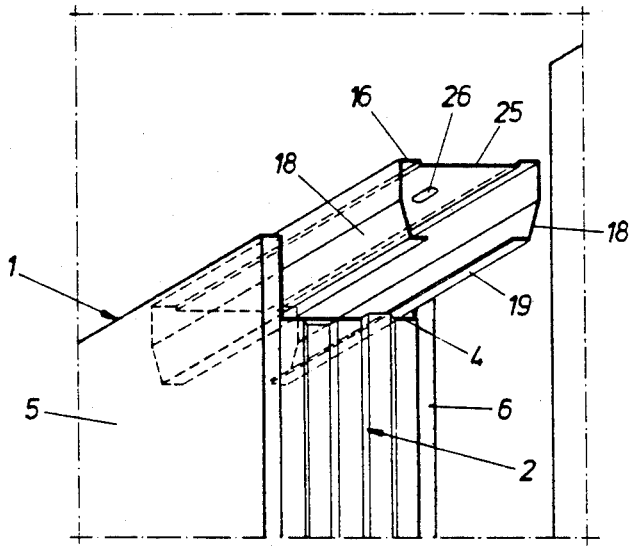
FIGS. 2 and 3 are graphic representations of the ceiling connections of the wall panel.
Figure 3:
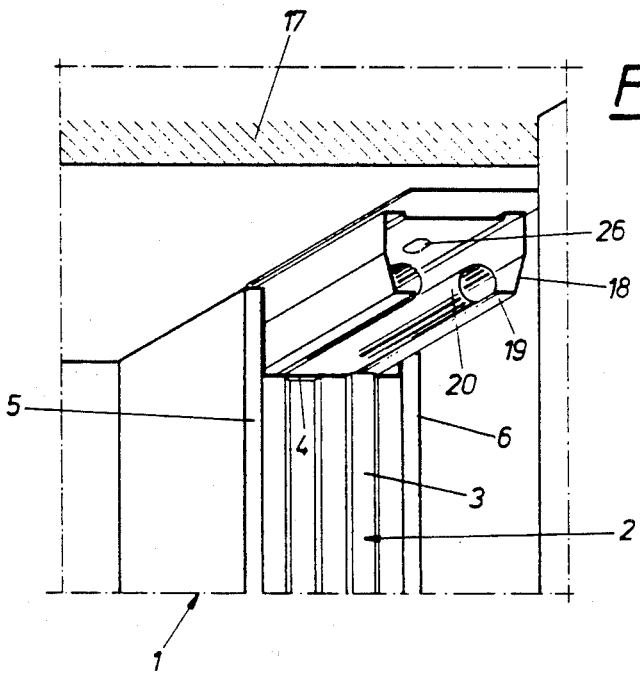
Figure 8:
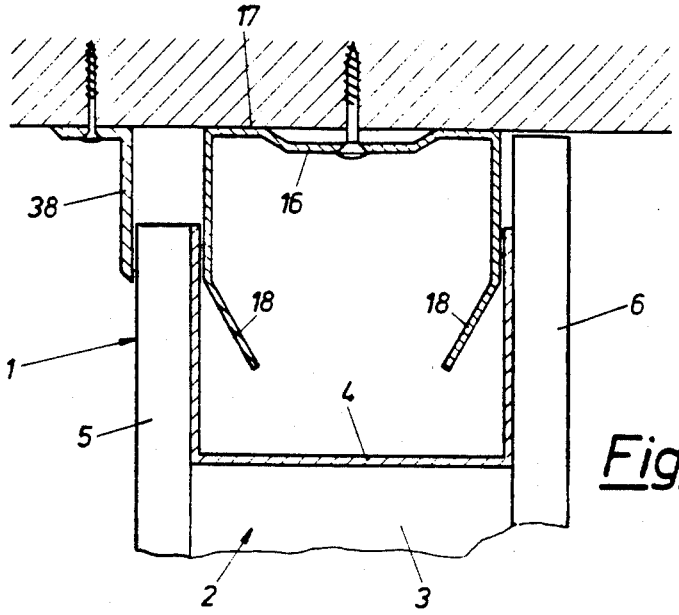
FIG. 8 shows two versions of the ceiling connection system.

In accordance with FIGS. 1 to **14*i*, the wall panel, generally indicated by 1, and comprising metal or steel bearing frame 2, has an edge profile 3 and a cross profile 4. In FIGS. 2, 3 and 8, respectively there is shown only one section having an edge profile 3 and upper cross profile 4, while in FIGS. 4 and 5 there is shown a section featuring the lower cross profile 4 of bearing frame 2**.

Figure 15:
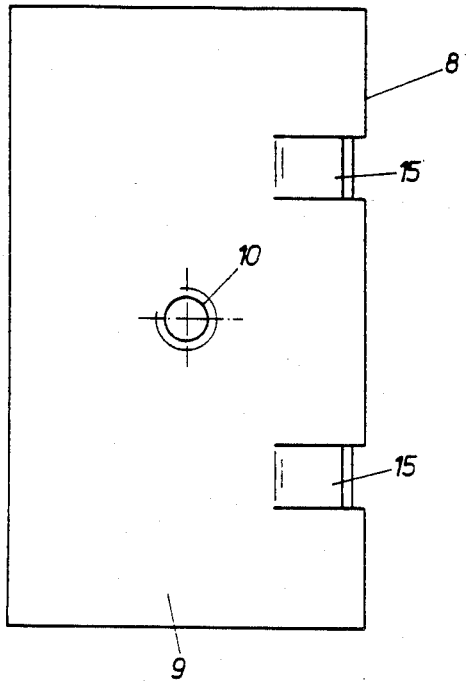
FIGS. 15 to 17 show the adjustment means together with the floor connection.
Figure 16:
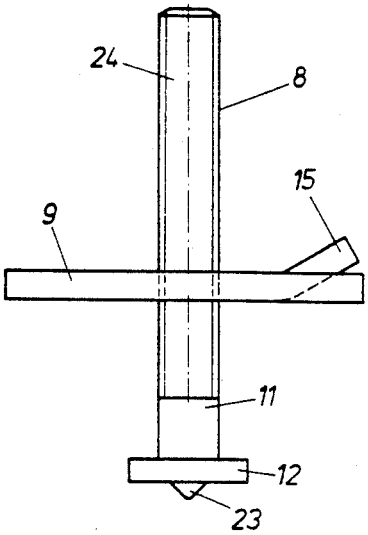
Figure 17:
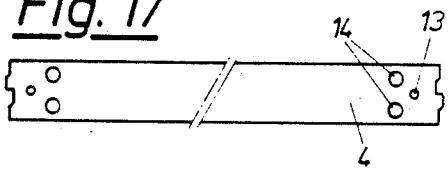

Attached to such frames, which are constructed of the edge and cross profiles, are suitably rigid covering sheets 5 and 6, e.g. gypsum sheets, which can be attached to the frames with screws, nails, adhesives, etc. Such covering sheets can be trimmed to size on site. In the embodiments illustrated in FIGS. 1, 5 or 6 and 8, trimming locations for wall panel 1 are provided by recessing the upper or lower cross profile 4 by a wide margin in relation to the edge of sheets 5 and 6. The cavity that is thus created in the edge zone of panel 1 is, in the floor zone, occupied by an interchangeable spacing profile 7 whose size and height can be freely chosen, and which is merely slid into or removably secured in panel 1. In this zone, both covering sheets 5 and 6 are secured only to the cross profile 4 or the edge profiles 3. It is also possible to trim panel 1 along the upper or lower edge in order to make the panel fit the height of the room in which it is to be installed, without impairing the bearing structure of the panel. The latter is, additionally, provided with bracing devices or compensating supports 8 that serve to compensate for differences in size or unevennesses in the floor. The bracing device can be more easily seen in FIGS. 15 and 16. In the embodiment shown, bracing device or compensating device 8 comprises a plate 9, which is removably attached, in particular so as to be capable of being inserted or mounted, on the spacing profile. Plate 9 also features a threaded bore 10, into which an adjusting set screw 11, having a support head 12, is screwed (FIGS. 15, 16). Lower cross profile 4 and, if required, the spacing profile situated thereunder, are formed with suitable apertures or bores 13 or 14 serving to accommodate the adjusting set screw 11 and plate 9. FIGS. 15 and 16 show suspension hooks 15 on plate 9, by means of which the latter can be suspended on cross profile 4 or spacing profile 7.

Figure 33:
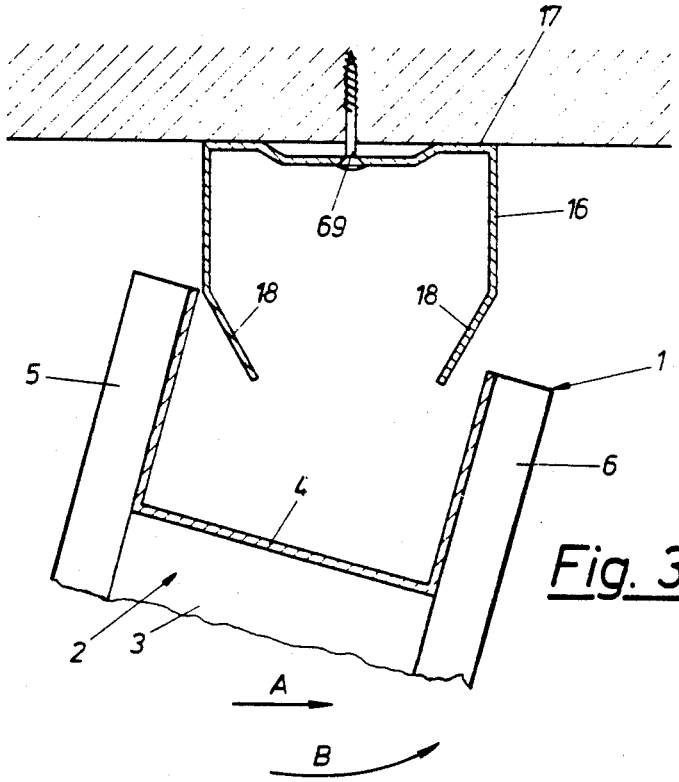
FIG. 33 illustrates the fitting of a wall panel over the proposed bearing part.
Figure 19:
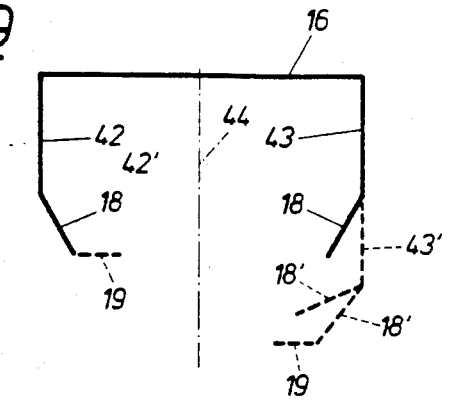
FIG. 19 shows a section through a symmetrical bearing part and—as indicated in broken lines—an asymmetrical bearing part.

Of particular importance to the present invention is bearing part 16, which for the purpose of erecting and positioning the wall panels during assembly, is first fixed to the ceiling 17. Bearing part 16, which can have a symmetrical (FIGS. 1, 2, 3, 4, and 5) or asymmetrical design, (FIG. 19), possesses shank ends 18 that are bent towards the center and which can also be bent at the extreme, in particular lowest, end 19 toward the median of the profile at right angles to the median plane of such profile, in order both to reinforce the profile and facilitate the accommodation of electrical conduits (FIG. 3). Such bearing parts 16 permit—as shown in FIG. 33—wall panel 1 to be fitted or guided with ease onto such bearing part 16 and can, if arranged in the zone of the separation between two wall panels 1 that are to be erected adjacent to each other, that is to say, between two adjoining wall panels, ensure the flush assembly of such adjacent panels 1 (FIGS. 2, 3, 6).

In addition to the height adjustment provided by set screw 11 or replaceable spacing profile 7, a means of adjusting the width of panel 1 is shown in FIGS. 1 to 11g, and FIGS. 12 and 13. A means of adjusting or adapting the width of the panel is provided in the same, or in a manner similar to, that employed in adjusting the height of the panel, whereby edge profile 3 is recessed inside panel 1 relative to the edge of such panel and interchangeable spacing profiles similar to spacing profile 7 are provided or double profiles are provided. A practical and effective means of fitting panels to each other is provided in accordance with FIGS. 11 to 13 by the ability of bearing frame sections to slide laterally in relation to each other. For this purpose, there is secured to the upper and lower faces of the edge profile or rather stud 3, a U-track part 4' or 4'' of cross profile 4, that runs at an angle from the edge profile or stud 3 and lies on top of cross profile 4'' or $4^{IV}$ that is embodied as a U-profile. The connection of the cross profile sections 4',4'' or 4'',$4^{IV}$, which can be slid toward each other, can be accomplished by means of self-tapping screws or similar components that are screwed into the profiles at sites designated as points $4^{V}$,$4^{VI}$, and are screwed through covering sheets 5,6.

The wall panel illustrated is provided with a filling 21 having heat/and or acoustic insulating properties, which can be, for example, mineral wool. Filling 21 is compressable or can, in order to fit the size of the wall panel, be trimmed at the edges.

In FIGS. 15 and 16, the (adjusting) set screw 11 and nut 9 are shown in greater detail in enlarged scale. (Adjusting) set screw 11 features, in accordance with FIGS. 4, 5, 6, a hexagonal head 22 as well as a centered anchoring tip 23. The hexagonal head can, for the purpose of screwing adjusting screw 11 inside threaded bore of nut 9, be adjusted by a hexagonal wrench. Head 12 of (adjusting) set screw 11 is provided with centering projection 23 that is arranged coaxially in relation to the screw axis and can be pressed into the floor. Nut 9 has somewhat the shape of a rectangular plate, provided in whose one edge zone are the above-mentioned hooks 15 serving to either suspend or secure nut 9 to the lower cross profile 4 or spacing profile 7 in the openings of such profile.

The secured sheet connection as well as the extent of adaptability of panel 1 to varying spatial requirements are showing in the drawings.

Figure 4:
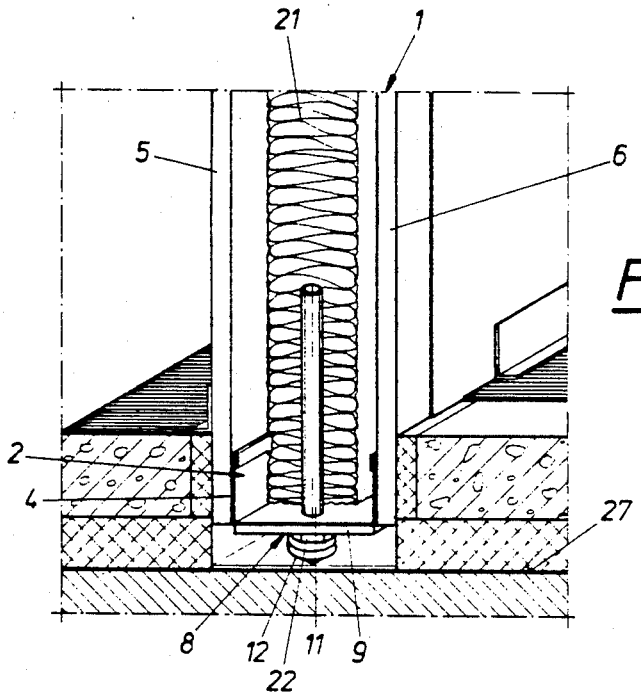
FIGS. 4 and 5 show graphically the means of connecting the wall panel to the floor.

In FIG. 4, which shows the unextended setting, wall panel 1 has been cut to the extent of its trimming margin, i.e. up to the bottom side of the cross profile 4, whereby height adjustment means 11 is screwed back into its lowest setting, thus permitting cross profile 4 to sit practically on top of the sub floor layer.

Figure 5:
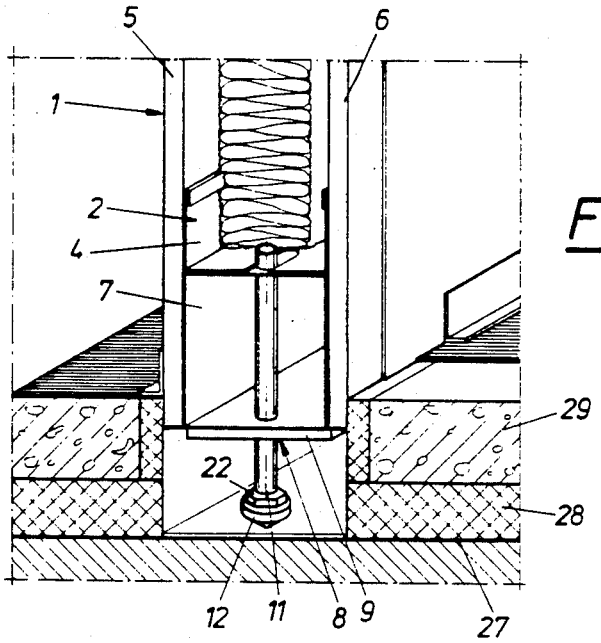
Figure 6:
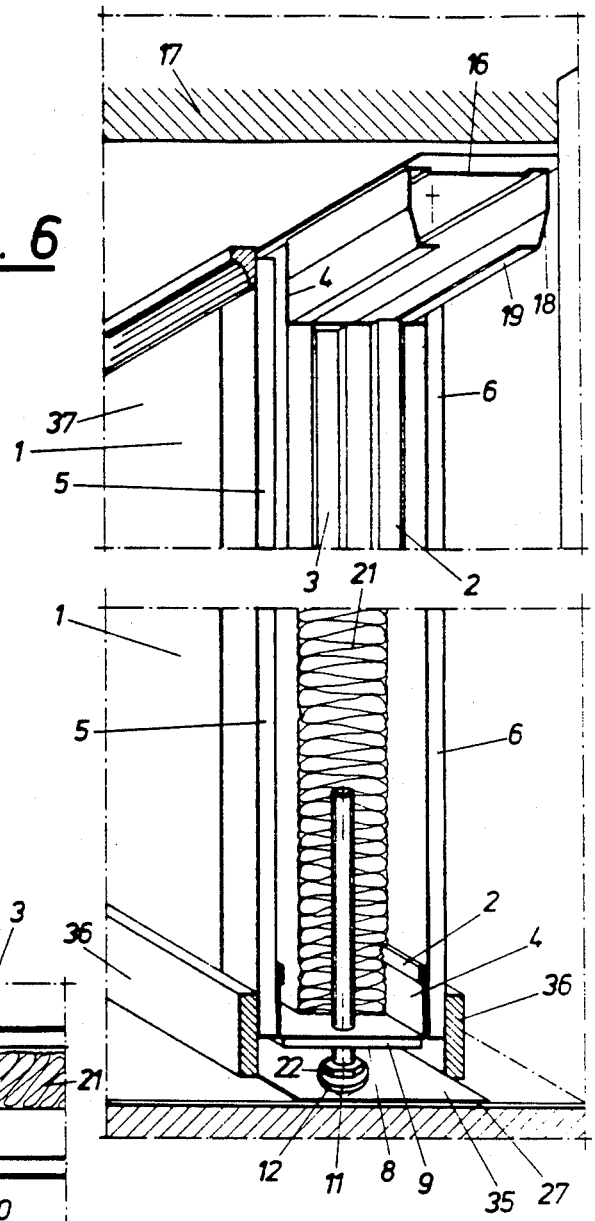
FIGS. 6 and 7 are graphic representations of a mobile partition, with their ceiling, floor and lateral connecting systems.

FIGS. 1 and 5 show the proposed panel at its maximum height setting, in relation to the sub floor level 27 of the room. (Adjusting) set screw 11 is shown screwed out to its furthest bearing setting. The gap resulting in the latter case between the bottom edge of the panel and the sub floor level 27, is later covered by floor structures 28, 29.

In FIGS. 2 and 3 there is shown a method whereby bearing part 16, whose web 25 is profiled, is effectively screwed to ceiling 17. Slots which, during installation, allow for slippage in bearing panel 16 are provided in web 25.

Figure 7:
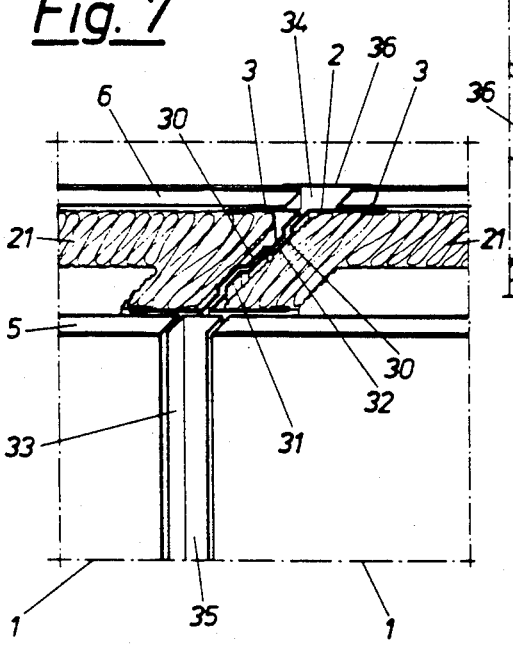

FIGS. 6 and 7 illustrate a mobile partition wall in longitudinal or cross-section. FIG. 7 indicates the lateral joining site of two adjacent walls. The edge profiles 3 of the bearing frame possesses a profiled web 30. Such profiling can, as shown here and in FIGS. **9*b*, 9*d*, 11*c*, 11*e*, 13, 14*b*, 14*f*, 25*b*, 25*d*, 28 and especially in FIGS. 18, 20 and 21, have a trapezoidal cross-section featuring rises 31 and depressions 32, whereby rises of one edge profile 3 or its web 30 fit into depressions provided in edge profile 3 or its web 30 of the adjacent wall panel 1. In the mobile partition wall of FIG. 7, covering sheets 5, 6 are recessed from webs 30 of edge profile 3 to permit joint 33, 34 to remain open after assembly. In the space between the sheets 5 and 6, on one side there is a C or U profile 35 and the space is covered with covering means 36**.

Insulating material or, for purposes of acoustic insulation, mineral wool 21, is provided in the cavity between the wall panels, as can be seen at the bottom of FIG. 6. It is also practical to provide such mobile walls with a bracing device 8 to 12 mentioned above, having a set screw 11 arranged on the bottom edge of wall panel 1. Attention is drawn to the lower part of FIG. 6, which also features a strip of insulation 35 located beneath set screw 11 or its head 12 as well as a sealing strip 36 serving to cover the gap formed between the lower edge of the wall panel and the floor. Covering sheets 5, 6 are, in practice, usually covered with wall coverings 37 or a coat of paint.

The danger of ceiling beam sagging increases with the ceiling area. In such cases, a modification of the arrangement of the upper part of the wall panel can provide an effective solution as can be ascertained from the left portion of FIG. 8. Either covering sheets 5 or 6 and the flanges of the upper frame profile 4 end, after assembly of wall panel 1, at a distance from ceiling 17, so that, during any sagging of the latter, the edge of covering sheet 5, 6 does not, as opposed to the version shown at the right of FIG. 8, come into contact with the ceiling and risk damage whereby furthermore bearing part 16 is permitted to slide with its flanges inside the flanges of profile 4, since the ends 18 of the flanges of bearing part 16 are, after assembly, held at a distance from the web of profile 4. The gap formed between the wall panel 1 and the lower ceiling layer 17 can be effectively sealed by elastic sealing strips such as a rubber seal 38 having an angular cross-section.

Figure 9:
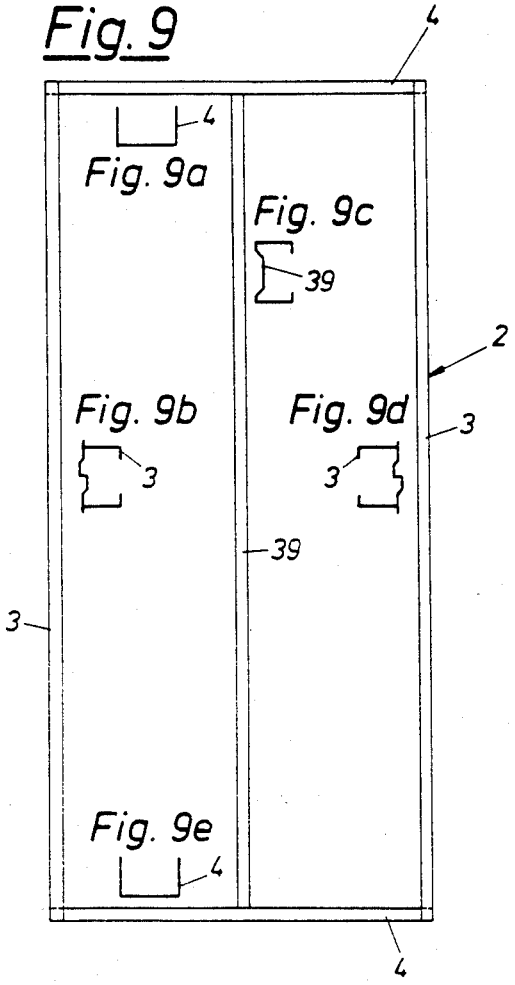
FIGS. 9 to **9*e* as well as FIG. 10** show a stationary frame construction.
Figure 10:
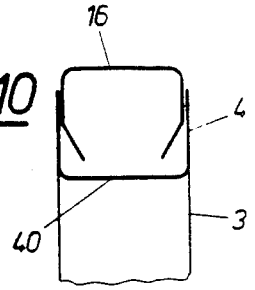

The construction of a frame 2 in accordance with FIG. 9 that is reinforced by a central stud 39 having a profiled cross-section in accordance with FIG. 9*c*, is illustrated with the aid of profile section according to FIGS. 9*a* to 9*e* and primarily by FIG. 10.

In order to clarify this arrangement, the profile sections of FIGS. 9*a* to 9*e* are drawn in directly beside the appropriate profiles of the bearing frame. Upper edge profile 4 remains open even in the zone of lateral profiles 3, in order to permit plumbing pipes 20 (See also FIGS. 1 and 3) as well as electrical wiring to be arranged in or drawn through the lateral flanks of the wall panels. In this arrangement, edge profiles 3 as well as central profile 39 have similar sections 40 that are open at the top, i.e. sections that are as close as possible in shape to the outer surface of edge profile 4 (See FIG. 10).

Figure 11:
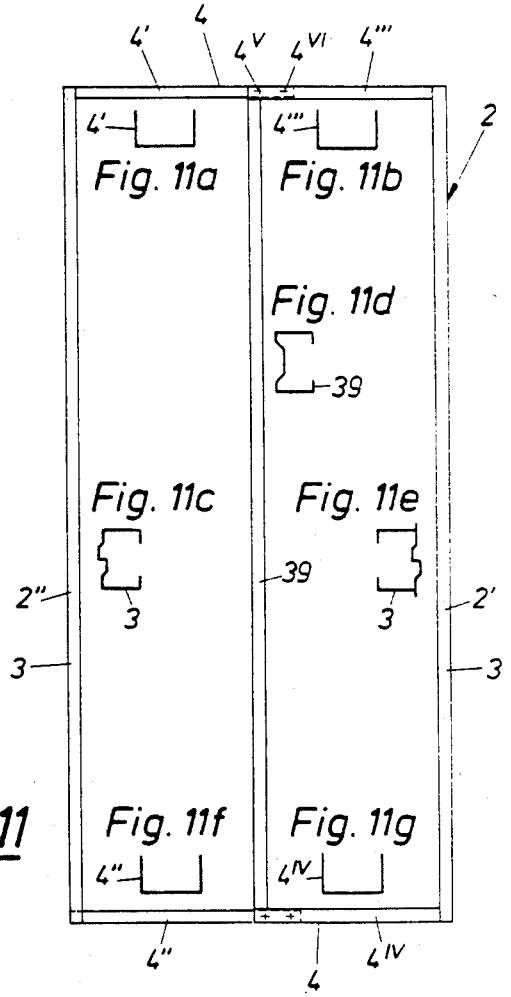
FIGS. 11 to **11*g*** show U and C profiles of varying widths, in the extended condition.

The bearing frame in accordance with FIG. 11 which can be adjusted to accommodate changing width requirements is constructed of two partial frames 2', 2''. The partial frame 2', which is, again, reinforced by means of a stud 39, comprises profiles 3, 4'' and $4^{IV}$ and the partial frame 2'' comprises profiles 3, 4' and 4''. Profile sections 4' and 4'', as mentioned above, first rest in protruding profile sections of profile 4'' ',$4^{IV}$, so as to be able to slide, while the above-mentioned fixing of sections 4',4 or 4'' ',$4^{IV}$ occurs after the assembly has been completed. The covering sheets are connected prior to assembly only with one of the partial frames, especially partial frame 2', so that the remaining portion of the covering sheets can be trimmed to correspond to the required distance of slide of the other partial frame. After assembly, the remaining covering sheet zones are also attached to the newly positioned partial frames 2'. The individual profile cross-sections again feature the appropriately assigned profiles illustrated in sub figures FIGS. 11*a* to 11*g*. In addition, FIGS. 12 and 13 show the frame parts in outline (FIG. 12) from the opposite side and in a plane view, as well as in the extended condition (in broken lines), and slid together, i.e. with the wall panel in its least extended condition. Used generally as covering sheets and suitable for use in connection with such partial frames are gypsum board, impregnated structural panels, fire retardant board, gypsum fiber board, asbestos cement board, cement bonded backing panels, as well as other types of structural boards depending on construction requirement.

In the frame construction shown in FIG. 4 having an opening 41, which more particularly serves as a serving hatch, there are partial frame constructions 42, 43 on the top and bottom inside a principal frame 2 having four outer profiles 3, 4, which are arranged at the top or at the bottom of such frame, and are represented as profile cross-sections in FIGS. 14*a* to 14*i*.

Figure 18:
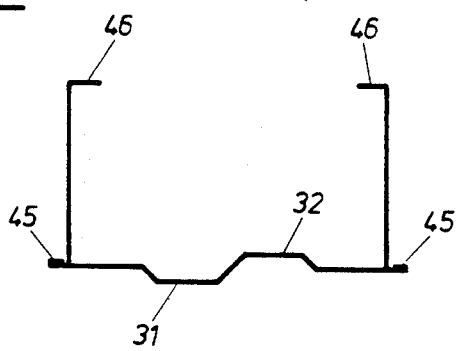
FIG. 18 shows a cross-sectional profile view of a lateral profile of the bearing frame.

FIG. 18 shows a cross-section of a lateral profile 44 of bearing frame 2 featuring projections 45, which project beyond the lateral surfaces of the profile flanges. Such projections 45 are capable of serving as abutments for the covering sheet edges or the reinforcement means. Additional bends 46, which can be provided on the flange ends, serve the purpose of reinforcement.

Bearing part 16, which is shown in section in FIG. 9, preferably possesses shanks of equal length 42, 43, but is equally capable of functioning with shanks 42', 43', of unequal lengths, whereby the shank bends 18, 18' can enclose different angles with the axis of symmetry 44 of the profile or can be of different lengths. Such inequalities in length can facilitate assembly while simplifying the installation of wiring and piping, especially if the above-mentioned additional bends 19 are provided at the shank ends.

Figure 20:
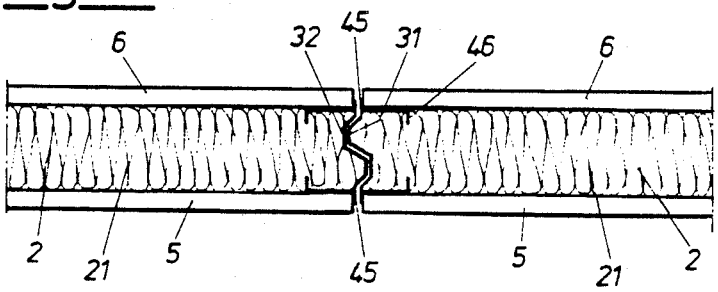
FIG. 20 shows a modified version of the inner wall filling.
Figure 21:
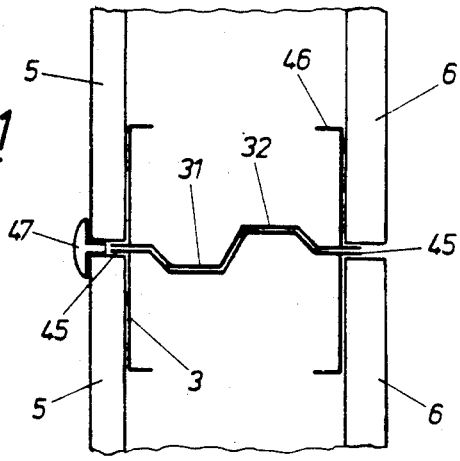
FIG. 21 shows a similar arrangement having a joint cover.

FIG. 20 is a plane view of the filling of the inside of a wall, which differs from the embodiment of FIG. 7 in that the profile joints are practically eliminated and the covering sheets 5, 6 sit against the above-mentioned projections 45 and whereby in addition bends 46 project toward the inside of the wall panel. Sheets 5,6 are gypsum board, frame 2 comprises steel profiles and mineral wool is used for insulation 21. FIG. 21 shows a detail of a similar embodiment, in which case however, the very narrow partial joint is covered by a strip 47.

Figure 23:
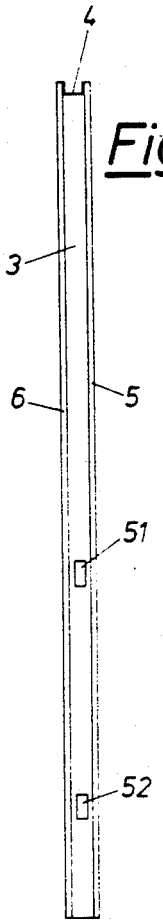
Figure 22:
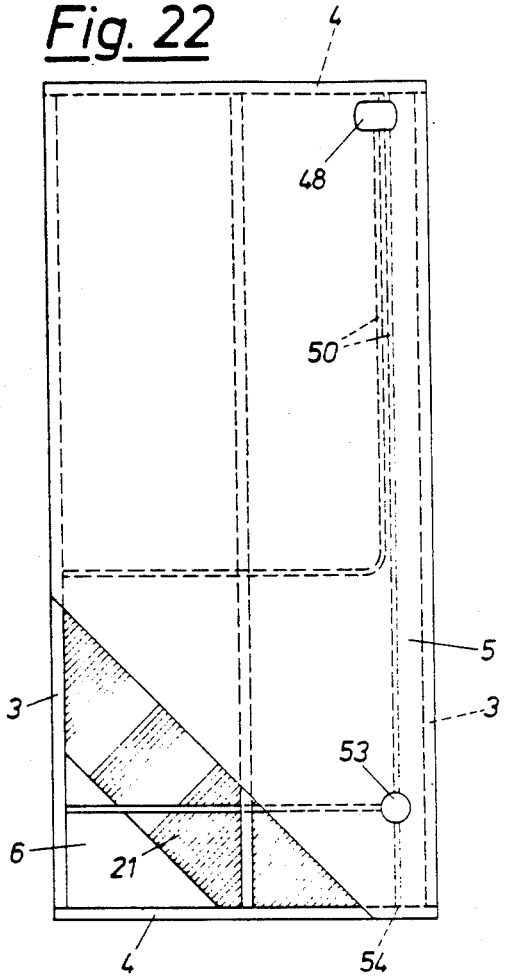
FIGS. 22 to **24*a*** show a wall panel prepared to accept electrical wiring.
Figure 24:
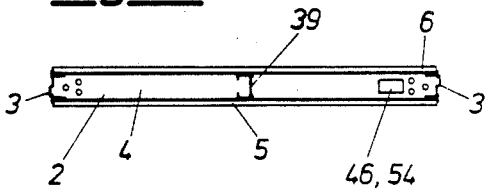
Figure 25:
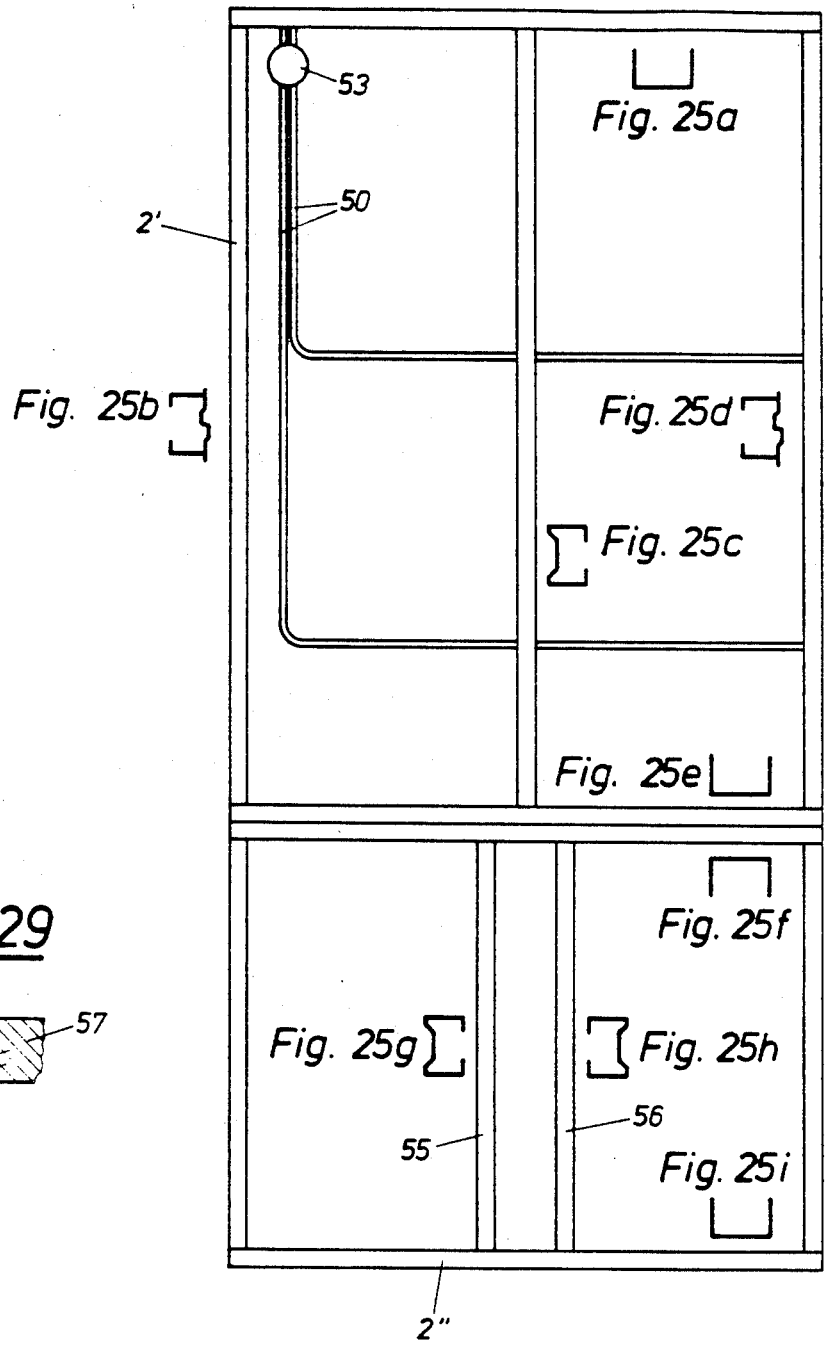
FIGS. 25 to **25*i* and 26 to 29** show a wall panel prepared to accommodate sanitary pipes.
Figure 29:
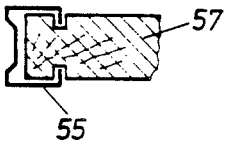
Figure 26:
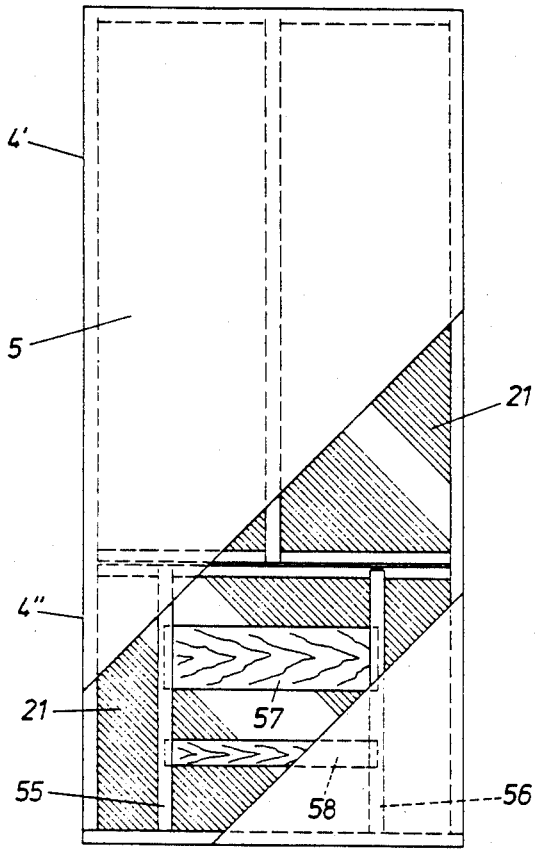
Figure 27:
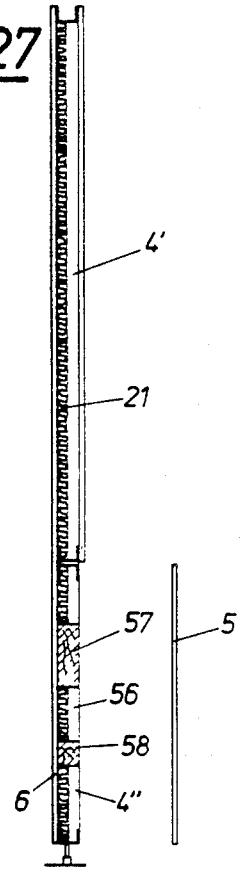
Figure 28:
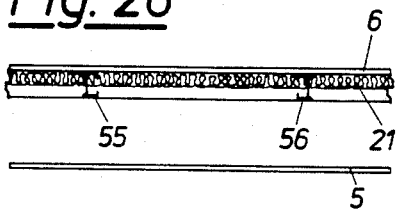

FIGS. 2 to 24 illustrate—in partially broken away fashion—a plane view (FIG. 22), a side view (FIG. 23) and a view of the upper and lower narrow sides of a wall panel modified for electrical wiring. Opening 48 in covering sheet 5 permits the insertion of electric wiring and the subsequent mounting of power outlets. Electric wires or cables can also be laid inside the upper profile 4, from which position the wires can also be drawn downward through openings 49 disposed in the web of this profile, whereby especially bendable power or insulating conduits 50 arranged between the covering sheets are able to accommodate such conduits. Further openings 51, 52, 53 and 54 are provided on lateral profile 3 or on web profile 4 or on the covering sheet in order to distribute the wiring or to accommodate switches, wall sockets or branch boxes. The above-described installations inside a specially modified wall panel improve the adaptability of industrially prefabricated wall panels to different building designs. Similar preparations can be made for sanitary plumbing in wall panels in accordance with FIGS. 25 to 29, wherein, however, the upper partial frame 2'' is adapted to receive sanitary conduits. The sections shown in FIGS. 25*a* to 25*i*, which are assigned to their respective adjacent profiles of the bearing frame, clarify again the mechanical structure of the bearing frame. Slidable studs 55, 56 are arranged inside the lower partial frame 2'', between which wooden planks 57, 58 (See also FIG. 29) can be inserted on the building site up to any height within lower partial frame 2''. Covering sheet 5 of the lower partial frame 2'' can be removed or is fixed in position after mounting plates 57, 58 have been placed in position, whereafter the sanitary plumbing, e.g. wash basin and valves, etc. can be installed, without further preparation, on the constructions site.

Figure 30:
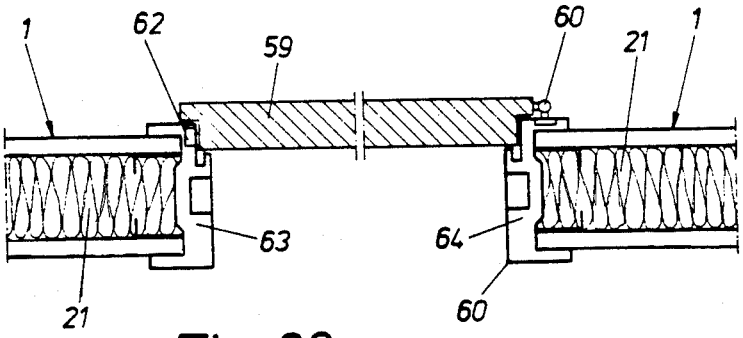
FIGS. 30, **30*a* and 30*b*** show in detail the arrangement for an interior wall door.

FIG. 30 shows an alternate version of the proposed wall panel, while FIGS. 30a, 30*b* show a horizontal partial section through a wall panel 1 of a further version in the zone of an interior partition door 59 or a graphic representation of such wall panel 1 (FIG. 30*a*), whereby specially designed steel door frames 60 having recesses 63, 64 serve as stops, which are filled in with foam or plastic. Door frames 60 are rest on profiles 3.

FIGS. 30*a*, 30*b* feature moreover a spacing plate 61, a guide reinforcement 61' and displacement screws 61''.

Figure 31:
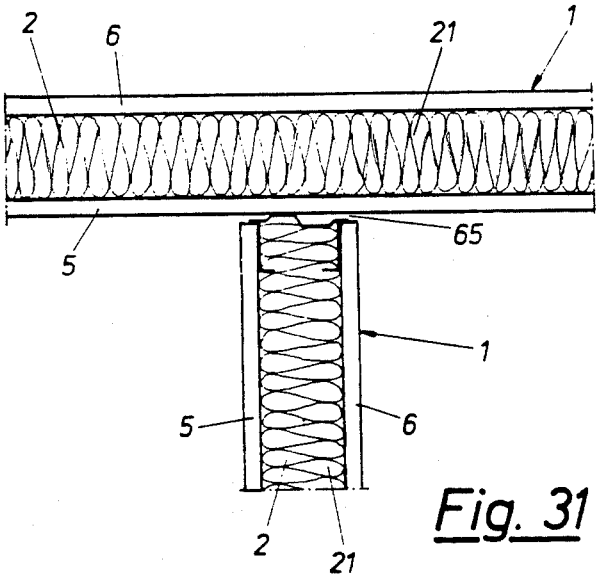
FIG. 31 shows the contact zone of two interior walls that meet at right angles.

FIG. 31 shows a joint 65 between two partition walls, which is filled with plastic between lateral profile 4 and the adjacent covering sheet 5. FIGS. 32 and 32*a* show in outline and in graphic representation a similar arrangement involving the joint between partition wall and cover whereby featured is an additional gypsum strip or similar material 66 as well as joints 67, 68 that, again, are filled with plastic foam or another material. Edge profiles are again referred to by 3 or 4.

FIG. 33 shows schematically the advantage of the present invention, as related to the erection of the wall panel 1 with the aid of the above-mentioned special bearing part 16 is featuring bent shank ends 18. Wall panels 1 are, in this case, brought at an angle from the left onto bearing part 16, which has already been fixed to ceiling 17, for example, with the aid of screws 69 that are inserted through slots in the web of bearing part 16. Wall panel 1 is then brought into a vertical position by a slewing motion indicated by arrow B, whereby the shanks of profile 4 are slid onto the shanks of profile 16. This procedure considerably facilitates the erection of the awkward and heavy wall panels, wherein the edge profiles 4 of bearing frame 2, which open toward the top, play an equally important role. The above mentioned bracing devices located on the bottom edge of the wall panel serve to complete, in effective manner, this simplified erection procedure, and the removable or interchangeable distancing profiles and the capacity of the covering sheets to be trimmed, are essential additional features.

What is claimed is:

1. A wall panel arrangement with wall panels for the interior structure of a building having a ceiling, comprising:

a bearing frame having first and second sides, upper and lower sides, and including first and second U shaped profiles, each said U shaped profile including spaced apart shanks;

first and second covering sheets attached respectively to the first and second sides of the bearing frame;

filling material, disposed between the first and second covering sheets for providing insulation;

a bracing member, disposed on the lower edge of the bearing frame, for compensating for dimensional differences between the wall panel and the building structure accommodating the wall panel;

at least one of the edges of the bearing frame being recessible relative to an edge surface of at least one of the covering sheet the first U shaped profile of the bearing frame being disposed adjacent the lower edge of the bearing frame between the first and second covering sheets with;

a ceiling bearing member, defining a U shaped profile having shanks separated by a web, mounted to the ceiling;

each of said shanks having a length and an end, the shank ends being bent at about mid-shank length towards the other shank to define an acute angle with respect to a median profile plane;

the shanks of the second U shaped profile of the bearing frame being spaced apart a distance greater than the distance separating the shanks of the ceiling bearing member, the second U shaped profile being disposed adjacent the upper edge of the bearing frame between the first and second covering sheets such that the shanks of the ceiling bearing member extend into a space between the shanks of the second U shaped profile and are retained therein by the shanks of the second U shaped profile; and means for securing the web of the ceiling bearing member to the ceiling, for concealably mounting the wall panel to the building structure.

2. A wall panel arrangement according to claim 1, wherein the shanks of the ceiling bearing member are shorter than the shanks of the second U shaped profile.

3. A wall panel arrangement according to claim 1, wherein the shank ends of the ceiling bearing member are further bent approximately normally with respect to the median profile plane, the further bent shank ends comprising substantially less than half the shank length.

4. A wall panel arrangement according to claim 1, further including a third U shaped profile for bracing the bearing frame;

the third U shaped profile disposed within the bearing frame between an inwardly opening U shaped profile and an outwardly opening U shaped profile.

5. A wall panel arrangement according to claim 1, wherein the upper side of the bearing frame includes:

a closed section, attached to the first and second covering sheets; and an open frame profile, sized to slidably engage within the said closed section and be temporarily attached to the first and second covering sheets;

so that the first and second covering sheets may be trimmed in a slide path of the open frame profile.

6. A wall panel arrangement according to claim 1, wherein a wall panel disposed above the ceiling bearing member includes a vertically disposed closed frame defining a U shaped profile open at an uppermost edge defining a lower limit;

said closed frame being disposed surrounding the ceiling bearing member, such that the U shaped profile is adapted to rest atop a downwardly opening U shaped profile of a frame disposed immediately therebeneath;

the frame disposed immediately therebeneath including an upwardly opening U shaped profile defining a lower limit;

wherein a vertical U shaped profile is slidably disposed in a profile space of a profile of a lower closed frame;

a lumber-like member being disposed between vertical profiles.

7. A wall panel arrangement according to claim 1, wherein the first and second covering sheets have a height less than a distance separating the ceiling from a floor in the structure, and wherein the bracing member causes a zone adjacent ends of the shanks of the second U shaped profile to be disposed adjacent the ceiling bearing member, and further including an elastic angular profile disposed to bridge a separation between the ceiling and an upper-most edge of the covering sheets.

8. A wall panel arrangement according to claim 1, wherein the shanks of the ceiling bearing member have different lengths.

9. A wall panel arrangement according to claim 1, wherein:

a U shaped profile adjacent the lower edge of the bearing frame defines a hole in the web; and the bracing member includes:

a plate, disposed beneath said web, the plate defining a threaded hole; and a screw having a head and a length, threadably engaging the plate, wherein the screw head rests against a floor of the building structure, and adjusting the screw length compensates for dimensional differences.

10. A wall panel arrangement according to claim 9, further including an interchangeable and hollow spacing member disposed substantially between the first and second covering sheets between the web of the first U shaped member and a floor of the building structure;

the spacing member including an aperture wherein said plate is disposed.

11. A wall panel arrangement according to claim 1, wherein a wall panel disposed above the ceiling bearing member includes a vertically disposed closed frame defining a U shaped profile open at an uppermost edge defining a lower limit;

said closed frame being disposed surrounding the ceiling member, such that the U shaped profile is adapted to rest atop an upwardly opening U shaped profile and a lower frame situated thereunder;

said lower frame having an uppermost and downwardly opening U shaped profile disposed at a distance from said upwardly opening U shaped profile, said distance defining a separation zone;

wherein the first and second covering sheets are interrupted by said separation zone.

12. A wall panel arrangement according to claim 11, further including a standing profile supporting said closed frame on an inside;

said closed frame disposed vertically between the first and second covering sheets between adjacent standing profiles; the adjacent standing profiles disposed parallel to a standing outer profile of the wall panel arrangement and comprising lateral profiles of said closed frames.

13. A wall panel arrangement with wall panels for the interior structure of a building having ceiling, comprising:

a bearing frame having first and second sides, upper and lower sides, and including first and second U shaped profiles, each said U shaped profile including spaced apart shanks;

first and second covering sheets attached respectively to the first and second sides of the bearing frame;

filling material, disposed between the first and second covering sheets for providing insulation;

a bracing member, disposed on the lower edge of the bearing frame, for compensating for dimensional differences between the wall panel and the building structure accommodating the wall panel;

at least one of the edges frame being recessible relative to an edge surface of a at least one of the covering sheet the first U shaped profile of the bearing frame being disposed adjacent the lower edge of the bearing frame between the first and second covering sheets with;

a ceiling bearing member, defining a U-shaped profile having shanks separated by a web, mounted to the ceiling;

each of said shanks having a length and an end, the shank ends being bent at about mid-shank length towards the other shank to define an acute angle with respect to a median profile plane;

the shanks of the second U shaped profile of the bearing frame being spaced apart a distance greater than the distance separating the shanks of the ceiling bearing member, the second U shaped profile being disposed adjacent the upper edge of the bearing frame between the first and second covering sheets such that the shanks of the ceiling bearing member extend into a space between the shanks of the second U shaped profile and are retained therein by the shanks of the second U shaped profile;

means for securing the web of the ceiling bearing member to the ceiling, for concealably mounting the wall panel to the building structure;

a wall panel disposed above the ceiling bearing member including a vertically disposed closed frame defining a U shaped profile open at an uppermost edge defining a lower limit;

said closed frame being disposed surrounding the ceiling bearing member, such that the U shaped profile is adapted to rest atop a downwardly opening U shaped profile of a frame disposed immediately therebeneath;

the frame disposed immediately therebeneath including an upwardly opening U shaped profile defining a lower limit;

a vertical U shaped profile being slidably disposed in a profile space of a profile of a lower closed frame;

a lumber-like member being disposed between vertical profiles.

14. A wall panel arrangement with wall panels for the interior structure of a building having a ceiling, comprising:

a bearing frame having first and second sides, upper and lower sides, and including first and second U shaped profiles, each said U shaped profile including spaced apart shanks;

first and second covering sheets attached respectively to the first and second sides of the bearing frame;

filling material, disposed between the first and second covering sheets for providing insulation;

a bracing member, disposed on the lower edge of the bearing frame, for compensating for dimensional differences between the wall panel and the building structure accommodating the wall panel;

at least one of the edges frame being recessible relative to an edge surface of a at least one of the covering sheet the first U shaped profile of the bearing frame being disposed adjacent the lower edge of the bearing frame between the first and second covering sheets with;

a ceiling bearing member, defining a U-shaped profile having shanks separated by a web, mounted to the ceiling;

each of said shanks having a length and an end, the shank ends being bent at about mid-shank length towards the other shank to define an acute angle with respect to a median profile plane;

the shanks of the second U shaped profile of the bearing frame being spaced apart a distance greater than the distance separating the shanks of the ceiling bearing member, the second U shaped profile being disposed adjacent the upper edge of the bearing frame between the first and second covering sheets such that the shanks of the ceiling bearing member extend into a space between the shanks of the second U shaped profile and are retained therein by the shanks of the second U shaped profile; and means for securing the web of the ceiling bearing member to the ceiling, for concealably mounting the wall panel to the building structure;

a wall panel disposed above the ceiling bearing member including a vertically disposed closed frame defining a U shaped profile open at an uppermost edge defining a lower limit;

said closed frame being disposed surrounding the ceiling member, such that the U shaped profile is adapted to rest atop an upwardly opening U shaped profile and a lower frame situated thereunder;

said closed frame being supported on an inner side by a vertical profile, said vertical profile providing a lateral profile of said closed frame and being disposed parallel to a vertical outer profile of a wall panel;

said lower frame having an uppermost and downwardly opening U shaped profile disposed at a distance from said upwardly opening U shaped profile, said distance defining a separation zone;

wherein the first and second covering sheets are interrupted by said separation zone.

* * * * *